US010697157B2

(12) United States Patent
Zhang et al.

(10) Patent No.: US 10,697,157 B2
(45) Date of Patent: Jun. 30, 2020

(54) COUNTER-TOP RAPID INSTALLATION DEVICE FOR TAP

(71) Applicant: NINGBO AOLEISHI SANITARY WARE CO., LTD., Ningbo (CN)

(72) Inventors: Wei Zhang, Ningbo (CN); Yong Wang, Ningbo (CN); Jiade Wang, Ningbo (CN); Yier Zhang, Ningbo (CN)

( * ) Notice: Subject to any disclaimer, the term of this patent is extended or adjusted under 35 U.S.C. 154(b) by 0 days.

(21) Appl. No.: 15/996,512

(22) Filed: Jun. 3, 2018

(65) Prior Publication Data

US 2019/0003161 A1 Jan. 3, 2019

Related U.S. Application Data

(63) Continuation of application No. PCT/CN2015/096350, filed on Dec. 3, 2015.

(51) Int. Cl.
*E03C 1/04* (2006.01)
*E03C 1/02* (2006.01)

(52) U.S. Cl.
CPC ..... *E03C 1/0402* (2013.01); *E03C 1/021* (2013.01)

(58) Field of Classification Search
CPC ..... E03C 1/0402; E03C 1/021
USPC ..... 4/695
See application file for complete search history.

(56) References Cited

U.S. PATENT DOCUMENTS

| | | | | |
|---|---|---|---|---|
| 6,807,692 | B2 | 10/2004 | Tsutsui et al. | |
| 6,874,527 | B2 | 4/2005 | Meeder | |
| 2002/0189674 | A1 | 12/2002 | Meeder | |
| 2014/0230144 | A1* | 8/2014 | Bors | E03C 1/0401 4/695 |

FOREIGN PATENT DOCUMENTS

CN 104929198 A 9/2015

OTHER PUBLICATIONS

International Search Report of PCT/CN2015/096350, dated Sep. 8, 2016.

* cited by examiner

*Primary Examiner* — Lauren A Crane
(74) *Attorney, Agent, or Firm* — W&K IP

(57) ABSTRACT

The present disclosure discloses a counter-top rapid installation device for a faucet, comprising a faucet body (1) positioned on a counter (7), a screw sleeve (3) fitted inside an installation hole on the counter (7) and used to install the faucet body (1), an mounting seat (4) and at least two sliders (5) for limiting axial displacement between the counter (7) and the screw sleeve (3), the mounting seat (4) is in sleeving connection to the periphery of the screw sleeve (3), the periphery of the screw sleeve (3) corresponding to the position below the counter (7) is provided with at least two through holes (3.2) that allow the slider (5) to slide outward from the inner cavity of the screw sleeve (3). The device can be installed on a counter rapidly and conveniently, and achieves improved axial limiting effect relative to the counter.

10 Claims, 7 Drawing Sheets

COUNTER-TOP RAPID INSTALLATION DEVICE FOR TAP

CROSS-REFERENCE TO RELATED APPLICATIONS

This application is a continuation of International Patent Application No. PCT/CN2015/096350 with a filing date of Dec. 3, 2015, designating the United States, now pending. The content of the aforementioned applications, including any intervening amendments thereto, are incorporated herein by reference.

TECHNICAL FIELD

The invention relates to the field of faucet installation, in particular to a counter-top rapid installation device for a faucet.

BACKGROUND

The installation of the conventional faucet is usually carried out below the counter, so that a professional person needs to bend down, squat or lie beneath the washbasin where is narrow and dark while a plurality of special tools are required. It's time and labor costing to assemble and install under the counter. In regard of the above defects, a counter-top faucet installation method is introduced in the market. As the application published as US 20120137427A1, discloses a counter-top faucet installation method comprising two screw rods and two locking pieces, the two screw rods have occupied a part of the space of the mounting hole, so that the space for the water inlet pipe is decreased, which leads to a limitation of the size of the water inlet pipe. The width direction of the locking pieces have further occupied part of the space of the mounting hole, which not only leads to a more limited space for water inlet pipe but also makes the installation inconvenient and more time consuming. Meanwhile, the supporting is realized only by two screw rods with limited diameters, the strength of the faucet cannot be well guaranteed, and is of poor shearing resistance. There is also products utilizing a magnetic clamping block to realize the installation in the prior art, however, with unpleasant reliability and higher installation requirement, the cost also increases.

SUMMARY

The present disclosure discloses a counter-top rapid installation device for a faucet, quick and convenient to install and better in axial limiting with the counter.

The technical scheme of the present disclosure is as follows: a counter-top rapid installation device for a faucet, comprising a faucet body positioned on a counter, a screw sleeve fitted inside an installation hole on the counter and used to install the faucet body, an mounting seat and at least two sliders for limiting axial displacement between the counter and the screw sleeve, the mounting seat is in sleeving connection to the periphery of the screw sleeve, the periphery of the screw sleeve corresponding to the position below the counter is provided with at least two through holes that allow the slider to slide outward from the inner cavity of the screw sleeve, wherein the installation device further comprises an auxiliary installation tool for driving the sliders to protrude from the through hole to achieve the axial limiting function of the sliders and the screw sleeve is provided with a hollow inner cavity in which the auxiliary installation tool can slide so as to drive the sliders.

Compared with the prior art, the counter-top rapid installation device includes a screw sleeve for installing the faucet body, a mounting seat for limiting the axial displacement between the counter and the screw sleeve and at least two sliders, the outer periphery of the screw sleeve, close to the lower position of the counter is provided with two through holes allowing the sliders to slide out of the inner cavity of the screw sleeve, the slider extends out of the through hole during installation, and the upper end surface of the slider abuts against the lower end of the counter so as to achieve axial limiting. In other words, the slider can be driven to extend out of the through hole of the screw sleeve when the auxiliary installation tool slides insider the inner cavity of the screw sleeve, so that the slider abuts against the lower end of the counter to play a good axial limiting effect, the auxiliary installation tool can be taken out when the installation is completed, a wrench or other tools are used for tightening the mounting seat until the mounting seat abuts against the upper end of the counter, and the faucet is completely limited; with compact structure and convenient operation, the faucet can be quickly installed above the washbasin, with good strength and high anti-shearing capability, the faucet is not likely to loosing or shaking after installation. In addition, a large space is formed in the screw sleeve for both the cold and hot water pipe, the size of the water inlet pipe thus no longer greatly limited.

BRIEF DESCRIPTION OF THE DRAWINGS

In FIGS. 1-11: 1 faucet body, 2 auxiliary installation tool, 2.1 bearing, connecting part, 2.3 transition part, 2.4 straight cylinder part, 2.5 guiding block, 2.6 convex plate, 2.7 base, 3 screw sleeve, 3.1 guiding groove, 3.2 through hole; 4 mounting seat, 5 first anti-disengaging part, 5.2 second anti-disengaging part, 5.3 groove, 5.4 anti-slip pad, 6 rubber band, 7 counter.

EMBODIMENTS

Figure 1:
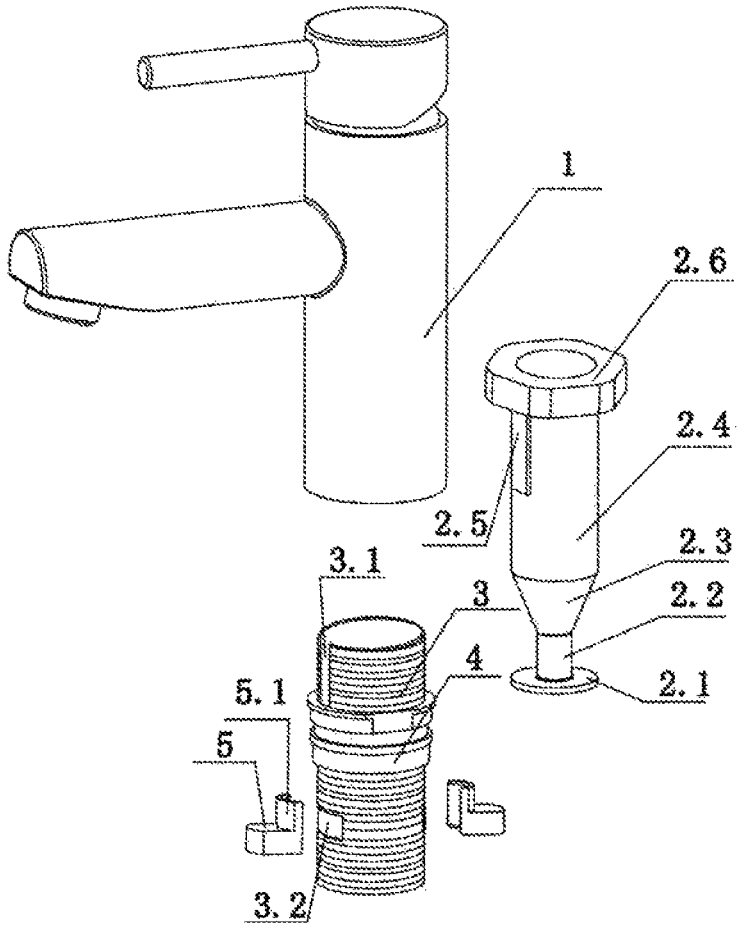
FIG. 1 is an exploded structural diagram of a counter-top rapid installation device for a faucet of the present disclosure.
Figure 2:
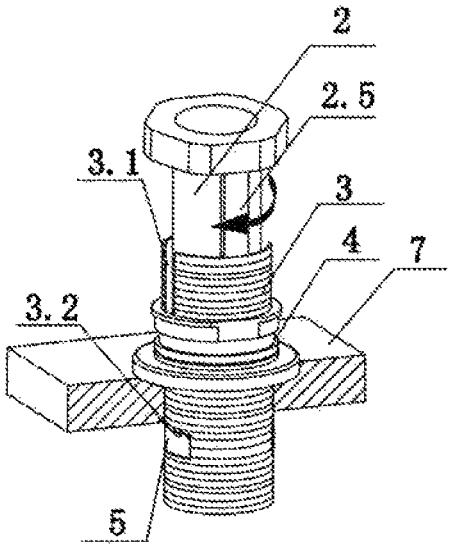
FIG. 2 is a schematic structural diagram of a counter-top rapid installation device for a faucet of the present disclosure (the auxiliary installation tool is in a positioning state).
Figure 3:
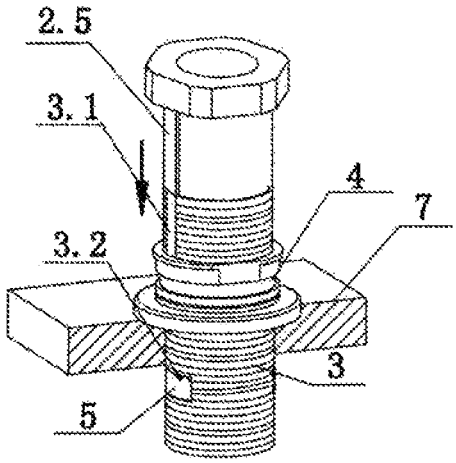
FIG. 3 is a schematic structural diagram of a counter-top rapid installation device for a faucet of the present disclosure (the auxiliary installation tool is in a ready-to-install state).

The embodiments of the present disclosure are further described below with reference to the drawings.

As shown in FIGS. 1-11, a counter-top rapid installation device for a faucet, comprising a faucet body 1 positioned on a counter 7, a screw sleeve 3 fitted inside an installation hole on the counter 7 and used to install the faucet body 1, an mounting seat 4 and at least two sliders 5 for limiting axial displacement between the counter 7) and the screw sleeve 3, the mounting seat 4 is in sleeving connection to the periphery of the screw sleeve 3, the periphery of the screw sleeve 3 corresponding to the position below the counter 7 is provided with at least two through holes 3.2 that allow the slider 5 to slide outward from the inner cavity of the screw sleeve 3, wherein the installation device further comprises an auxiliary installation tool 2 for driving the sliders 5 to protrude from the through hole 3.2 to achieve the axial limiting function of the sliders 5, and the screw sleeve 3 is provided with a hollow inner cavity in which the auxiliary installation tool 2 can slide so as to drive the sliders 5.

In some embodiment, the auxiliary installation tool 2 is arranged in the hollow inner cavity of the screw sleeve 3 in the initial state, and the bottom of the auxiliary installation tool 2 is provided with a bearing part 2.1 which is horizontally arranged and directly corresponds to the through hole 3.2 to support the slider 5 during the initial state so that the slider 5 be located in the inner cavity of the screw sleeve 3. A connecting part 2.2 is sequentially arranged above the bearing part 2.1, a transition part 2.3 with an inverted frustum shape and used for obliquely guiding when the auxiliary installation tool 2 move downwards along the inner cavity of the screw sleeve 3, and an opening part for pushing the slider 5 from inside the through hole 3.2 until it's in place, and the diameter of the opening part is larger than that of the connecting part 2.2. In this way, due to the arrangement of the bearing part 2.1, the size of the slider 5 can be designed to be larger and more contacting area with the counter and the reliability of the axial limiting can be effectively guaranteed. the position of the slider 5 is below the counter 7 during installation, it's difficult for the operator ensure that the slider 5 being aligned to the through hole 3.2 in the whole process, especially when the whole assembly is inserted into the mounting hole of the counter 7, the slider 5 may deviate even carefully operated. The horizontal bearing part 2.1 has reduced the possibility of misoperation and improved the installation efficiency. When the auxiliary installation tool 2 moves downwards along the inner cavity of the screw sleeve 3, the transition part 2.3 obliquely arranged gradually pushes the slider in place. The opening part extends upwards to form a straight cylinder part 2.4 matched with the inner circumferential shape of the screw sleeve 3, at least one guiding block 2.5 is axially arranged on the outer peripheral surface of the straight cylinder part 2.4, the outer peripheral surface of the screw sleeve 3 is provide with a guiding groove 3.1 matched with the guiding block 2.5 when the straight cylinder part 2.4 slides downwards, and when the lower end of the guiding block 2.5 abuts against the upper end of the screw sleeve 3, the bearing surface of the bearing part 2.1 of the auxiliary installation tool 2 and the low end surface of the through hole 3.2 stay flat so that the slider is aligned to the position of the through hole 3.2. In this way, the arrangement of the guiding block 2.5 ensures a good positioning, so that the bearing part 2.1 and the slider 5 can be aligned to the position of the through hole 3.2, and a good guiding when the auxiliary installation tool 2 slides downwards. A convex plate 2.6 is further arranged at the uppermost end of the straight cylinder part 2.4 for convenient operation. In general, the auxiliary installation tool can be preset as an installation assembly in the delivery and it makes the follow-up operation of the client more convenient.

As shown in FIGS. 1, 4, 6 and 9, the connecting part 2.2 of the auxiliary installing tool 2 and the transition part 2.3 are integrally arranged.

Figure 11:
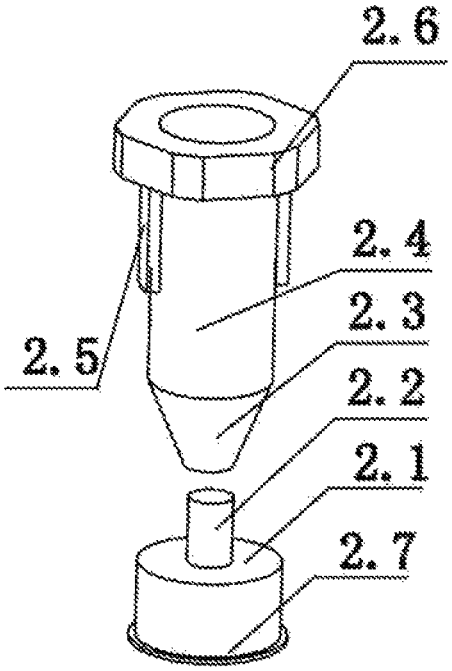
FIG. 11 is a schematic structural diagram of another embodiment of an auxiliary installation tool of a counter-top rapid installation device for a faucet of the present disclosure.

As shown in FIG. 11, the connecting part 2.2 and the transition part 2.3 of the auxiliary installing tool 2 are arranged in a split mode, the horizontally-arranged bearing part 2.1 and the connecting part 2.2 are arranged on the base 2.1. The structure of the straight cylinder part 2.4, the guiding block 2.5 and the convex plate 2.6 is in consistence with the structure of the above embodiment, and is not repeated herein.

In some embodiment, on the lower portion of the auxiliary installation tool 2 arranged an inverted frustum part to match with slider 5 for obliquely guiding when the auxiliary installation tool 2 slides downwards along the inner cavity of the screw sleeve 3 and an opening part for pushing the slider 5 until it's in place. That is, in the embodiment, only the inverted frustum part (of the same shape as the transition part 2.3) and the opening part (of the same structure as the straight cylinder part 2.4). The installation of the slider 5 can be realized by the simplified auxiliary installation tool 2, but it's more time consuming since the positions need to be aligned by the operator himself.

Figure 4:
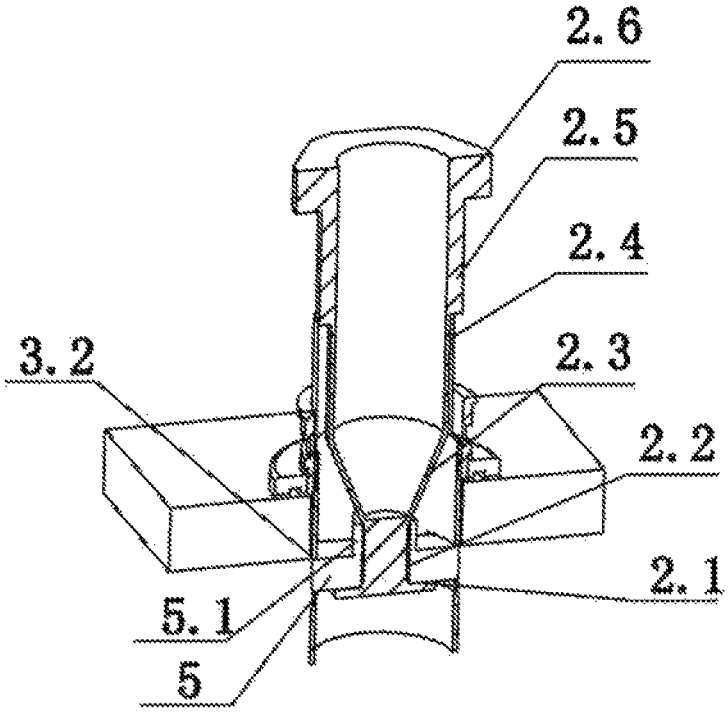
FIG. 4 is a sectional structural diagram of a counter-top rapid installation device for a faucet of the present disclosure.

The inner side wall of the slider 5 extends upwards to form a first anti-disengaging part 5.1 for preventing the slider 5 from falling out of the inner cavity of the screw sleeve 3, the inner wall of the first anti-disengaging part 5.1 of the slider 5 is of a cambered surface matched with the connecting part 2.2, and the inner wall of the first anti-disengaging part 5.1 abuts against the outer periphery of the connecting part 2.2 in the initial state. As shown in FIG. 4, the diameter of the connecting part and the width of the two sliders are smaller than or equal to the diameter of the screw sleeve 3. The other side wall of the slider 5 extends downwards to form a second anti-disengaging part 5. The slider 5 can be prevented from disengaging from the inner cavity of the screw sleeve 3, or completely falling into the inner cavity of the screw sleeve 3, to avoid unnecessary troubles. The matching effect between the slider 5 and the counter 7 is also enhanced.

An anti-slip mat 5.4 for skid resistance is arranged on the upper surface of the slider 5. The friction between the slider 5 and the counter 7 can be increased, so that a good anti-slip effect can be achieved, and the axial limiting effect of the slider 5 is better.

Figure 8:
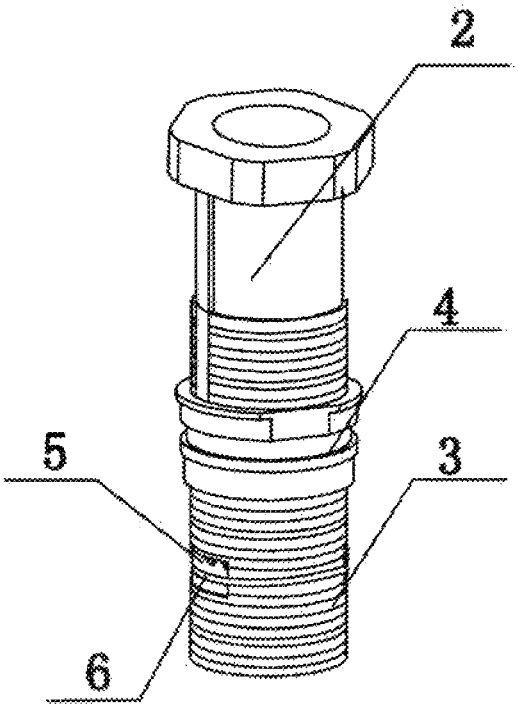
FIG. 8 is a schematic structural diagram of a counter-top rapid installation device for a faucet of another embodiment (the slider is in a built-in state).
Figure 9:
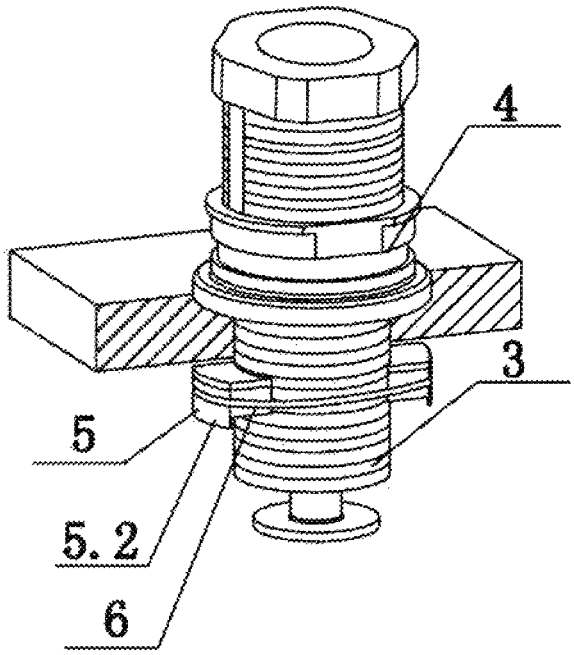
FIG. 9 is a schematic structural diagram of a counter-top rapid installation device for a faucet of another embodiment (the slider is in an extended state).
Figure 10:
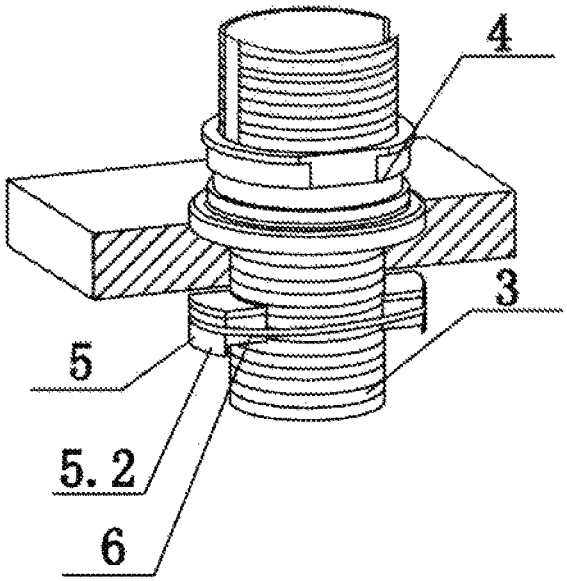
FIG. 10 is a schematic structural diagram of a counter-top rapid installation device for a faucet of another embodiment (the slider is in an extended state and the auxiliary installation tool is taken out).

The slider 5 is provided with a circumferential limiting mechanism, the circumferential limiting mechanism is an annular elastic piece encircling the sliders 5 and the periphery of the screw sleeve 3, the outer periphery of the slider 5 is provided with a groove 5.3 for embedding the annular elastic piece 6. During installation, utilize the auxiliary installing tool 2 to push the slider 5 to extend out of the through hole 3.2, screw the mounting seat 4 until the lower end of the mounting seat 4 abuts against the upper end of the counter 7, and the upper end surface of the slider 5 abuts against the lower end of the counter 7, so as to limit the axial displacement between the counter 7 and the screw sleeve 3, pull the auxiliary installation tool 2 out of the inner cavity of the screw sleeve 3, and the annular elastic piece is in an elastic opening state. In this way, the annular elastic piece 6 can be used for fixing the pre-installing assembly (as shown in FIG. 8) as a whole, preventing the slider 5 from falling off. When the faucet needs to be disassembled after installation, one only needs to detach the faucet body only needs to be detached, unscrew the mounting seat 4, the slider 5 reenters into the inner cavity of the screw sleeve 3 from the through hole 3.2 under the influence of the elasticity of the annular elastic piece, and the convenient disassembly of the faucet is achieved. In some embodiment, the annular elastic piece is a rubber band 6.

The specific working theory of the present disclosure is as follows:

1) During pre-installation, the mounting seat is in threaded connection with the periphery of the screw sleeve, the mounting seat is screwed to a preset mounting position, the distance between the mounting seat and the through hole formed in the lower end of the screw sleeve is larger than or equal to the height of the counter; the auxiliary installation tool is inserted into the inner cavity of the screw sleeve, and a horizontal bearing part arranged at the bottom of the screw sleeve is used for positioning the slider to ensure the slider generally inside the inner cavity of the screw sleeve, and the position of the slider directly facing the through hole of the screw sleeve to form an assembled component;
2) Insert the above assembly component into the mounting hole of the counter, until the mounting seat is positioned with the upper end surface of the counter;
3) Press the auxiliary installation tool downwards, so that the obliquely guiding part of the auxiliary installation tool drives the slider to slide outwards along the through hole, the opening part of the auxiliary installing tool pushes the slider until it's in place, and the slider extends out of the through hole of the screw sleeve completely;
4) Screw the mounting seat until the lower end of the mounting seat abuts against the upper end of the counter, and the upper end surface of the slider abuts against the lower end of the counter, so that the axial displacement between the counter and the screw sleeve can be limited; pull out the auxiliary installation tool from the inner cavity of the screw sleeve;
5) Install the faucet body to the screw sleeve and the mounting seat;
6) Connect the water pipe to the faucet body.

Figure 5:
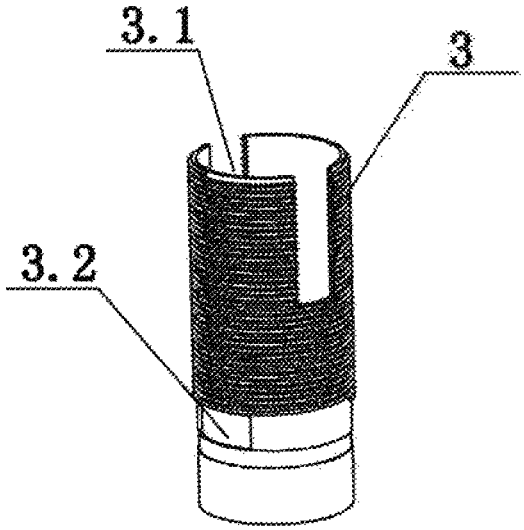
FIG. 5 is a schematic structural diagram of another embodiment of a screw sleeve of a counter-top rapid installation device for a faucet of the present disclosure.
Figure 6:
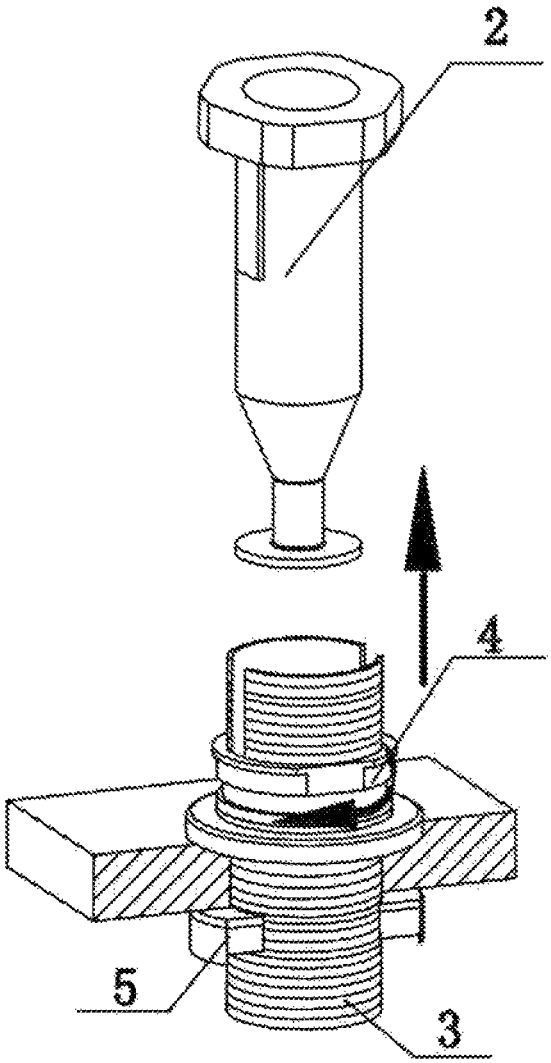
FIG. 6 is a schematic structural diagram of a counter-top rapid installation device for a faucet of the present disclosure (the slider extends outwards and the tool auxiliary installation tool is taken out).
Figure 7:
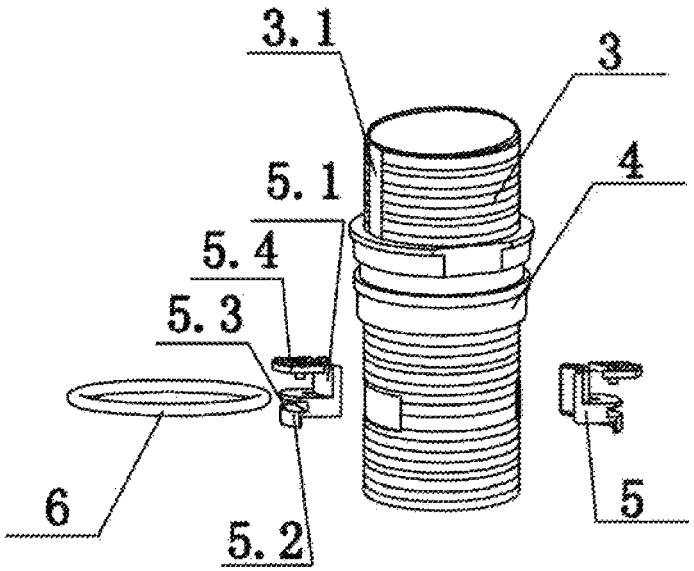
FIG. 7 is a schematic structural diagram of a counter-top rapid installation device for a faucet of another embodiment (the slider is in an exploded state).

As shown in FIGS. 1-8, the guiding groove 3.1 and the through hole 3.2 are formed at the same side of the screw sleeve 3, and the guiding groove 3.1 and the through hole 3.2 can be arranged separately as shown in FIG. 5, which is an easy alternative to those skilled in the art, just for the purpose of convenient machining.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A counter-top rapid installation device for a faucet, comprising a faucet body (1) positioned on a counter (7), a screw sleeve (3) fitted inside an installation hole on the counter (7) and used to install the faucet body (1), an mounting seat (4) and at least two sliders (5) for limiting axial displacement between the counter (7) and the screw sleeve (3), the mounting seat (4) is in sleeving connection to the periphery of the screw sleeve (3), the periphery of the screw sleeve (3) corresponding to the position below the counter (7) is provided with at least two through holes (3.2) that allow the slider (5) to slide outward from the inner cavity of the screw sleeve (3), wherein the installation device further comprises an auxiliary installation tool (2) for driving the sliders (5) to protrude from the through hole (3.2) to achieve the axial limiting function of the sliders (5); and the screw sleeve (3) is provided with a hollow inner cavity in which the auxiliary installation tool (2) can slide so as to drive the sliders (5).

2. A counter-top rapid installation device for a faucet of claim 1, wherein the auxiliary installation tool (2) is arranged in the hollow inner cavity of the screw sleeve (3) in the initial state, and the bottom of the auxiliary installation tool (2) is provided with a bearing part (2.1) which is horizontally arranged and directly corresponds to the through hole (3.2) to support the slider (5) during the initial state so that the slider (5) be located in the inner cavity of the screw sleeve (3).

3. A counter-top rapid installation device for a faucet of claim 2, wherein a connecting part (2.2) is sequentially arranged above the bearing part (2.1), a transition part (2.3) of an inverted frustum shape used for obliquely guiding when the auxiliary installation tool (2) moves downwards along the inner cavity of the screw sleeve (3), and an opening part for pushing the slider (5) from inside the through hole (3.2) until it's in place, and the diameter of the opening part is larger than that of the connecting part (2.2).

4. A counter-top rapid installation device for a faucet of claim 3, wherein the opening part extends upwards to form a straight cylinder part (2.4) matched with the inner circumferential shape of the screw sleeve (3), at least one guiding block (2.5) is axially arranged on the outer peripheral surface of the straight cylinder part (2.4), the outer peripheral surface of the screw sleeve (3) is provide with a guiding groove (3.1) matched with the guiding block (2.5) when the straight cylinder part (2.4) slides downwards, and when the lower end of the guiding block (2.5) abuts against the upper end of the screw sleeve (3), the bearing surface of the bearing part (2.1) of the auxiliary installation tool (2) and the lower end surface of the through hole (3.2) stay flat so that the slider is aligned to the position of the through hole (3.2).

5. A counter-top rapid installation device for a faucet of claim 4, wherein the connecting part (2.2) of the auxiliary installing tool (2) and the transition part (2.3) are integrally arranged.

6. A counter-top rapid installation device for a faucet of claim 1, wherein the lower part of the auxiliary installation tool (2) is provided with a inverted frustum part to match with the slider (5) for obliquely guiding when the auxiliary installation tool (2) move downwards along the inner cavity of the screw sleeve (3), and an opening part to push the slider (5) until it's in place.

7. A counter-top rapid installation device for a faucet of claim 3, wherein the inner side wall of the slider (5) extends upwards to form a first anti-disengaging part (5.1) for preventing the slider (5) from falling out of the inner cavity of the screw sleeve (3), the inner wall of the first anti-disengaging part (5.1) of the slider (5) is of a cambered surface matched with the connecting part (2.2), and the inner wall of the first anti-disengaging part (5.1) abuts against the outer periphery of the connecting part (2.2) in the initial state.

8. A counter-top rapid installation device for a faucet of claim 7, wherein the other side wall of the slider (5) extends downwards to form a second anti-disengaging part (5.2).

9. A counter-top rapid installation device for a faucet of claim 1, wherein the slider (5) is provided with a circumferential limiting mechanism, the circumferential limiting mechanism is an annular elastic piece encircling the sliders (5) and the periphery of the screw sleeve (3), the outer periphery of the slider (5) is provided with a groove (5.3) for embedding the annular elastic piece (6).

10. A counter-top rapid installation device for a faucet of claim 1, wherein an anti-slip mat (5.4) for skid resistance is arranged on the upper surface of the slider.

* * * * *